US009993092B2

(12) United States Patent
Walker

(10) Patent No.: US 9,993,092 B2
(45) Date of Patent: Jun. 12, 2018

(54) RAIL POSITION LOCK

(71) Applicant: Fasteners for Retail, Inc., Twinsburg, OH (US)

(72) Inventor: William H. Walker, Fairlawn, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days. days.

(21) Appl. No.: 15/462,037

(22) Filed: Mar. 17, 2017

(65) Prior Publication Data

US 2017/0258248 A1 Sep. 14, 2017

Related U.S. Application Data

(62) Division of application No. 14/684,720, filed on Apr. 13, 2015, now Pat. No. 9,629,483.

(60) Provisional application No. 61/979,270, filed on Apr. 14, 2014.

(51) Int. Cl.

| | |
|---|---|
| ***A47F 1/04*** | (2006.01) |
| ***A47F 5/00*** | (2006.01) |
| ***A47F 7/00*** | (2006.01) |
| ***A47G 29/087*** | (2006.01) |
| ***A47B 57/58*** | (2006.01) |
| *A47F 1/12* | (2006.01) |

(52) U.S. Cl.

CPC ..... *A47F 5/005* (2013.01); *A47B 57/583* (2013.01); *A47B 57/588* (2013.01); *A47F 5/0068* (2013.01); *A47F 1/125* (2013.01)

(58) Field of Classification Search

CPC ..... A47B 57/58; A47B 57/581; A47B 57/583; A47B 57/585; A47B 57/586; A47B 57/588; A47B 65/00; A47B 65/10; A47B 65/15; A47B 96/04; A47F 5/005; A47F 1/125; A47F 5/132; A47F 7/144; A47F 5/0068; A47F 5/0018; A47F 5/0025; A47F 5/16

USPC ..... 211/119.003, 184, 59.2, 59.3, 175; 108/60, 61; 312/61, 71; 40/642.01, 644, 40/653, 655

See application file for complete search history.

(56) References Cited

U.S. PATENT DOCUMENTS 2,516,122 A * 7/1950 Hughes ..... A47B 57/583 108/61
3,308,961 A * 3/1967 Chesley ..... A47F 1/121 211/59.3
3,559,815 A * 2/1971 Huddleston ..... A47F 5/005 211/184

(Continued)

OTHER PUBLICATIONS

FFR Merchandising Total Retail Solutions 2014 Product Catalog, cover page and pp. 240 and 241.

*Primary Examiner* — Jennifer E. Novosad
(74) *Attorney, Agent, or Firm* — Honigman Miller Schwartz and Cohn LLP

(57) ABSTRACT

A shelving assembly, held on an associated support surface, includes an elongated cooperating member including a first end and an opposite second end. A front rail is adapted to operably connect to the first end of the cooperating member and a rear rail is adapted to operably connect to the second end of the cooperating member. The rear rail includes at least one flexible member configured to abut a bottom surface of the cooperating member to retard a lateral movement of the cooperating member in a relation to at least the rear rail.

22 Claims, 3 Drawing Sheets

(56) References Cited

U.S. PATENT DOCUMENTS 3,698,568 A * 10/1972 Armstrong ..... A47F 5/005 211/184
4,395,955 A * 8/1983 Pfeifer ..... A47F 5/005 108/61
4,557,064 A * 12/1985 Thompson ..... G09F 3/204 40/361
4,611,720 A * 9/1986 Staab ..... A47F 7/0021 211/184
5,190,186 A * 3/1993 Yablans ..... G07F 11/60 221/124
5,341,945 A * 8/1994 Gibson ..... A47F 5/005 108/60
5,390,802 A * 2/1995 Pappagallo ..... A47B 45/00 211/187
5,489,031 A * 2/1996 Carroll ..... A47F 5/0068 211/134
5,673,801 A * 10/1997 Markson ..... A47F 1/126 211/184
5,690,038 A * 11/1997 Merit ..... A47F 5/005 108/60
5,779,064 A * 7/1998 Dolling ..... A47B 47/021 211/151
5,884,782 A * 3/1999 Dembicks ..... B25H 3/06 211/175
6,082,557 A * 7/2000 Leahy ..... A47B 57/58 211/184
6,227,385 B1 * 5/2001 Nickerson ..... A47F 1/126 108/61
6,290,077 B2 * 9/2001 Sosso ..... A47F 5/005 211/184
6,299,004 B1 * 10/2001 Thalenfeld ..... A47F 1/12 211/184
6,382,431 B1 * 5/2002 Burke ..... A47F 1/126 211/184
6,527,127 B2 * 3/2003 Dumontet ..... A47F 1/125 211/184
6,533,131 B2 * 3/2003 Bada ..... A47B 57/583 211/184
6,571,498 B1 * 6/2003 Cyrluk ..... G09F 3/204 108/27
6,889,854 B2 * 5/2005 Burke ..... A47F 1/126 211/59.3
7,140,499 B2 * 11/2006 Burke ..... A47F 1/126 211/184
7,216,770 B2 * 5/2007 Mueller ..... A47F 1/126 211/59.3
7,500,571 B2 * 3/2009 Hawkinson ..... A47F 1/126 211/59.3
7,913,861 B2 * 3/2011 Mueller ..... A47F 1/126 211/59.3
7,934,609 B2 * 5/2011 Alves ..... A47F 5/005 211/184
8,016,128 B2 * 9/2011 Valiulis ..... A47F 1/126 211/59.3
8,172,094 B2 * 5/2012 Meyer ..... A47F 5/005 211/134
8,260,456 B2 * 9/2012 Siegel ..... G06Q 10/08 221/4
8,496,126 B2 * 7/2013 Mueller ..... A47F 1/126 211/59.3
8,579,123 B2 * 11/2013 Mueller ..... A47F 1/126 211/59.3
2003/0141265 A1 * 7/2003 Jo ..... A47F 1/126 211/59.3
2004/0050811 A1 * 3/2004 Leahy ..... A47F 5/0043 211/134
2006/0096938 A1 * 5/2006 Kanou ..... A47F 3/0486 211/184
2010/0078402 A1 * 4/2010 Davis ..... A47B 57/585 211/184
2014/0001132 A1 * 1/2014 Berglund ..... A47F 5/0018 211/85.4
2014/0263134 A1 * 9/2014 Walker ..... A47F 5/005 211/184
2015/0289683 A1 * 10/2015 Walker ..... A47F 5/005 211/59.3

* cited by examiner

RAIL POSITION LOCK

CROSS-REFERENCE TO RELATED APPLICATIONS

The instant application is a Divisional of U.S. patent application Ser. No. 14/684,720, which was filed Apr. 13, 2015, which claims the benefit of U.S. Provisional Application Ser. No. 61/979,270, which was filed on Apr. 14, 2014, all of which are hereby incorporated by reference in their entirety.

BACKGROUND

The present disclosure relates to an adjustable merchandising system. More specifically, the present application relates to merchandising systems provided with a position lock for dividers or tracks mounted to a rail of the system, and will be described with particular reference thereto. However, it is to be appreciated that the present exemplary embodiment is also amenable to other like applications.

Merchandising systems are generally arranged to stock, store or display various products or merchandise, on shelving for example, for potential customers. Many stores sell various retail items that have various geometric shapes and sizes. It is therefore desirable to provide merchandising assemblies that are individually configurable to stock, store or display the various products being sold in various arrangements. One such merchandising assembly is a self-facing merchandising or shelving assembly which, urges product toward a front edge of a shelf. Such shelving assemblies are mounted on a shelf on which product is supported. The shelving assembly generally includes front and rear rails to which one or more dividers, tracks, side walls, or combination tracks and dividers are mounted.

Dividers neatly separate multiple products into columns on a shelf. They are commonly employed with track-mounted pushers which urge product forward on the shelf. Dividers and pusher assemblies are used to increase sales and enhance presentation of product on a shelf. Multiple sizes and styles are available. In some designs, a combined unit includes a divider mounted to the track. In many instances, these units are held on to the shelf by elongated mounting members, such as a front rail, and rear rail. The front rail can include a vertically oriented wall or fence aligned with a front edge of the shelf to prevent product from falling off the shelf. Generally, both the front and rear rails include an attachment profile that runs lengthwise along a width of the shelf. The divider, track, or the combined unit, which for simplicity's sake will all be termed cooperating member, is adapted to be connected to a front rail, and, if one is employed, a rear rail extending along the shelf at a desired position on the shelf. The attachment profiles of the cooperating members are adapted to support the cooperating member and can be adapted to retard or prevent movement of the cooperating member sideways along a longitudinal axis of the rails while also allowing a user to adjust the location of the cooperating member along the shelf as needed. One such example of a shelving system is provided by U.S. Pat. No. 8,496,126 to Mueller et al. The subject matter of that patent is incorporated herein by reference in its entirety.

However, it is known that some cooperating members can unintentionally shift laterally from a desired position on the shelf due to external forces. These forces could be caused by the stocking or retrieving of a product from the shelf. Additionally, cooperating member that includes moving parts such as a forward feeding system may include a spring loaded pusher that could, in the process of urging product forward on the shelf, shift or move the cooperating member laterally from its desired position relative to a rail mounted to the shelf.

Various different track systems and attachment profiles have been utilized to support the cooperating member on the one or more rails of such merchandising systems. To prevent or retard cooperating members from shifting laterally, particularly at the rear rail, various additional securing features have been employed. However, it is undesirable to provide a shelving system that includes securing features with additional parts or which requires complex geometries.

Therefore, there remains a need to provide a shelving system that can support cooperating members along the front and rear rails of the shelving system and that helps prevent unintended shifting or lateral movement of the cooperating member on a shelf without the use of additional parts or complex geometries and which also allows a user to optionally move the cooperating member sideways or laterally along the shelf as needed.

In one embodiment, the present disclosure pertains to a shelving assembly held on an associated support surface. The shelving assembly includes an elongated cooperating member including a first end and an opposite second end. A front rail is adapted to operably connect to the first end of the cooperating member and a rear rail is adapted to operably connect to the second end of the cooperating member. The rear rail includes a base wall and at least one flexible member which is connected to and extends away from the base wall and is configured to abut a bottom surface of the cooperating member to retard a lateral movement of the cooperating member in a relation to the rear rail.

In another embodiment of the present invention, provided is a rail for a shelving assembly. The rail includes a relatively rigid elongated body comprising a wall and a base from which the wall protrudes. At least one relatively flexible member is mounted to and extends away from the base, the at least one relatively flexible member being configured to abut a bottom surface of an associated cooperating member to retard lateral movement of the associated cooperating member relative to the rail.

According to another embodiment of the present disclosure, a rail for a shelving assembly comprises an elongated body, including a vertically extending wall and a horizontally extending base. The base includes an upper surface and a lower surface. A first flexible member is connected to and extends away from the upper surface of a base. A second flexible member is connected to and extends away from the lower surface of the base.

BRIEF DESCRIPTION OF THE DRAWINGS

The present disclosure may take form in certain parts and arrangements of parts, several embodiments of which will be described in detail in this specification and illustrated in the accompanying drawings which form a part hereof and wherein.

DETAILED DESCRIPTION

It is to be understood that the detailed figures are for purposes of illustrating exemplary embodiments of the present disclosure only and are not intended to be limiting. Additionally, it will be appreciated that the drawings are not to scale and that portions of certain elements may be exaggerated for the purpose of clarity and ease of illustration.

Figure 1:
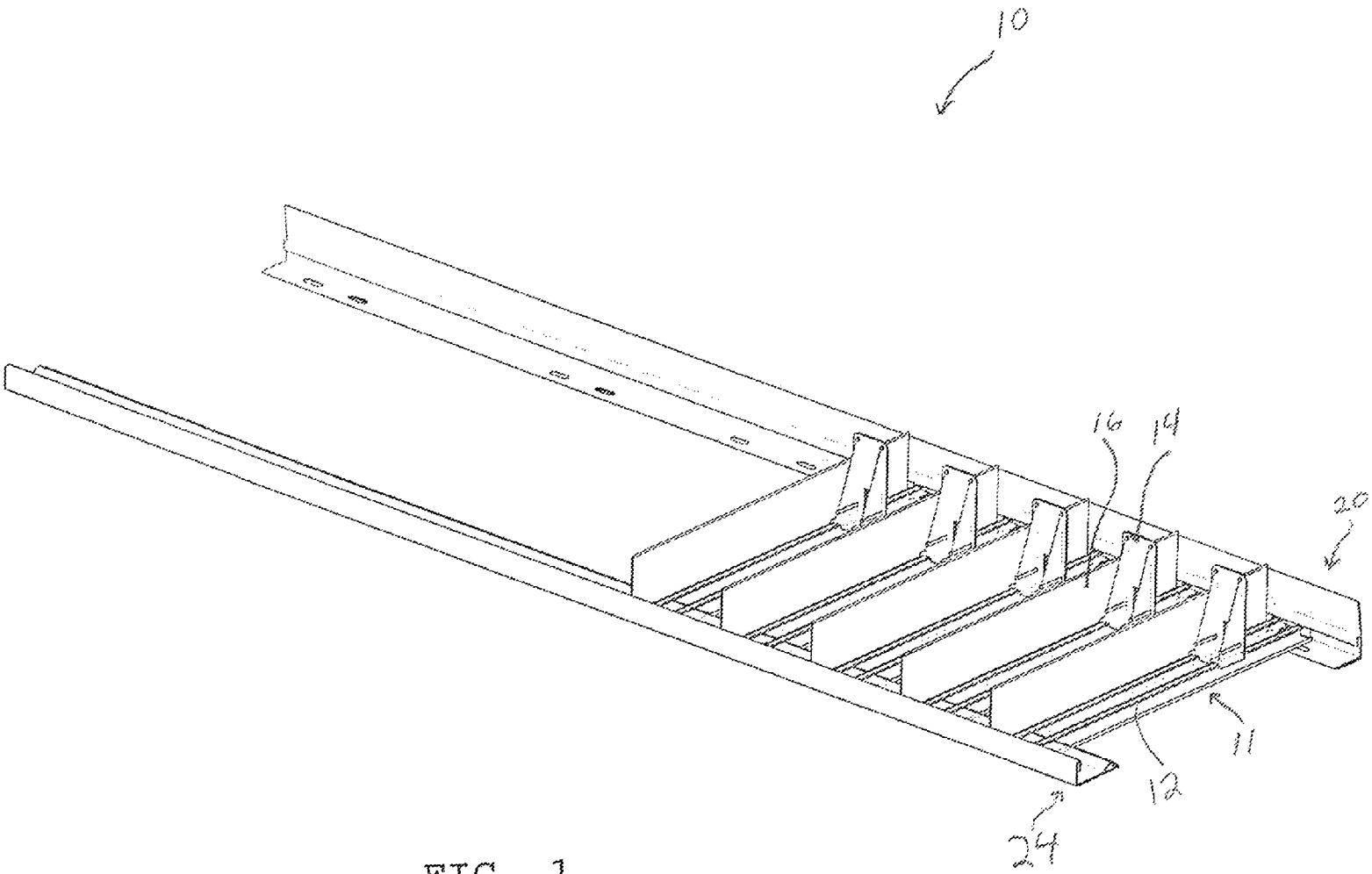
FIG. 1 is a perspective view of a shelving system having a front rail, a rear rail and a plurality of dividers according to one embodiment of the present disclosure.

In accordance with the present disclosure, FIG. 1 shows a perspective view of the components comprising a shelving system generally designated by reference numeral 10. The shelving system 10 includes a cooperating member having an elongated base member 11 which supports, in one embodiment, and elongated track 12, a product pusher paddle 14 movably mounted on the elongated track 12, a divider wall 16 extending from the base member 11 at a location adjacent to the track 12. Also provided are a front rail 20 and a rear rail 24. In one embodiment, the elongated base member 11 is slidably attached to the front rail 20 and, the rear rail 24. The shelving system 10 is adapted to be positioned on a shelf (not shown). The components of the shelving system 10 could be formed in accordance with the present disclosure from a conventional thermoplastic material, such as polyvinyl chloride plastic or any other suitable plastic by extrusion, molding, or any suitable plastic forming technique. The components can be alternatively made of any relatively rigid material such as a conventional metal or a compound material such as fiber reinforced plastic and may be of any color. One or more portions of the several components can also be transparent.

There are a variety of types of cooperating members for shelving systems that can be utilized with the front rail 20 and rear rail 24 as disclosed herein. For example, cooperating members, such as free standing dividers, drop in tracks and end dividers could be mounted to the front and rear rails in addition to the integrated track and divider shown. The cooperating members can generally include a base member 11. A divider wall 16 can be directly attached to the base member 11 to form a free standing divider. It is also known that a divider wall can be selectively connected to or detached from a base. Alternately, the base member 11 can accommodate a track 12 on which is mounted a product pusher 14. Numerous types of cooperating members are contemplated for use with the front rail 20 and rear rail 24 of this shelving system 10.

The shelving system 10 is configured in such a way so as to accept products or packages of various widths, depths, and configurations. More particularly, the spacing between adjacent tracks 12 can be adjusted to accommodate packages of different widths. Also, the shelving system can be employed on shelves of differing depths. As such, the cooperating members of different lengths can be provided to accommodate shelving of differing depths as the rear rail 24 and front rail 20 are placed along the rear portion and front portion of the shelf, respectively.

Figure 2:
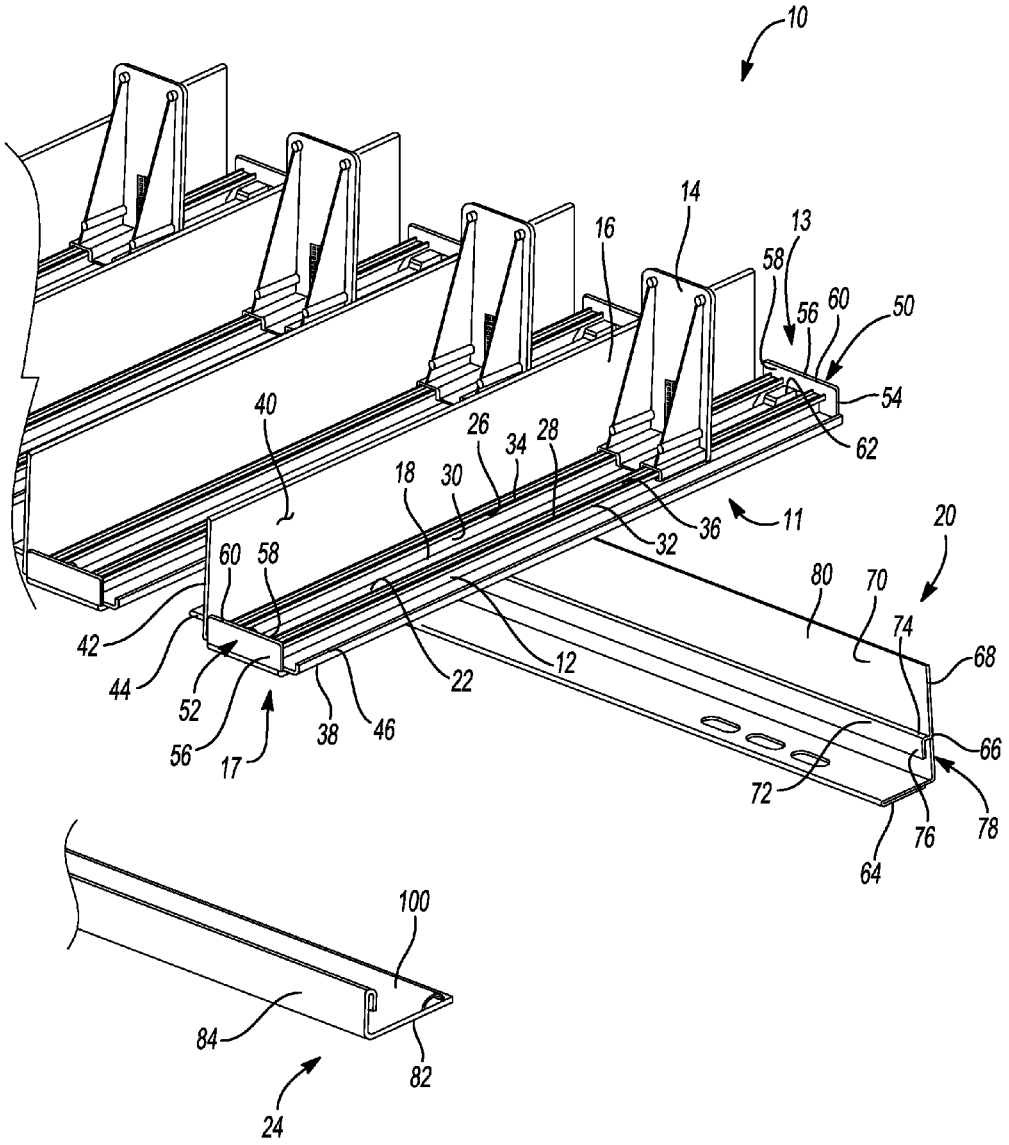
FIG. 2 is an enlarged exploded perspective view of a portion of the shelving system of FIG. 1.

The elongated base member 11 is generally configured to include a front end 13 and a rear end 17, as shown in FIG. 2. In one embodiment, the track 12 includes a channel 1$ defined between a pair of rails that is configured to allow the pusher paddle 14 to translate between the rear end portion 17 and the front end portion 13 of the base member 11. The channel is defined by a base wall 22 and spaced T-shaped rails 26, 28 that each includes a vertical, leg 30, 32 and a flattened horizontal surface 34, 36, respectively thereon. The T-shaped rails 26, 28 extend from the base wall 22 and can be collinear with the length of the track 12.

In this embodiment, the divider wall 16 extends generally perpendicular to the base wall 22. The divider wall 16 functions as a divider member to separate the shelf space into individual merchandise display areas. The divider wall 16 includes a first face 40, a second face 42, and a flange 44. The flange 44 is oriented generally transverse to the second face 42 of the divider wall 16 and extends collinear with the length of the track 12. The flange 44 is proximal to the base wall 22 and generally coplanar with the flattened horizontal surfaces 34, 36 of the T-shaped rails 26, 28. The base wall 22 includes a flange 46 that extends from the opposite side of the base from, the divider wall 16 and can be collinear with the length of the track 12.

As shown in FIG. 2, the elongated base member 11 in this embodiment includes a front clip 50 and a rear clip 52 attached to the base member front end portion 13 and rear end portion 17, respectively. Each clip 50, 52 includes a vertical rectangular plate 54 with a front face 56 and a rear face 58 and a top edge 60. The plate 54 includes a mounting element 62 extending transverse to the rear face 58 of the plate 54. The mounting element 62 is configured to slide in between the T-rails 26, 28 at the base front end portion 13 and the rear end portion 17 and frictionally engage the legs 30, 32, flattened horizontal surfaces 34, 36 and the base wall 22.

Shown in FIGS. 1 and 2 are the front rail 20 and the rear rail 24. These can be formed from elongated extruded elements that are cut to fit the length of the shelf. The front rail 20, and the rear rail 24 described hereinafter, generally allow the elongated cooperating members to be stably held and allow two spaced dividers 16 to define a width of a channel for holding a column of product. The front rail 20 and rear rail 24 hold the elongated cooperating members on the shelf at both the front and the back ends of the shelf. The front rail 20 and rear rail 24 are advantageously configured such that a plurality of elongated cooperating members can be slidably mounted to them. The front rail 20 is generally configured in an L-shaped arrangement with a base wall 64 and a front wall 66 extending upward in a direction generally transverse to the base wall 64. At least an upper portion of the front wall 66 may be comprised of a clear plastic material to allow a merchant or prospective purchaser a clear line of vision to the product being carried by the shelving system. The front wall 66 includes a front face 68 and a rear face 70.

A downward extending flange 72 projects from the rear face 68 of the front rail 20. The flange 72 includes a first leg 74 which extends generally perpendicular to the rear face 68 and a second leg 76 which extends generally perpendicular to the first leg 74. The second leg 76 extends downward generally parallel to the rear face 68. The first leg 74 and the second leg 76 form a downward extending flange configuration which defines an open slot 78. The open slot 78 is configured to receive the rectangular plate 54 of the front end clip 50. An upper portion 80 of the front wall 66 serves as a product retaining wall or fence which extends upward and preferably angles slightly rearward from a location above the flange 72. The product retaining wall 80 serves as a stopping surface for the shelving system 10. The product retaining wall 80 can utilize a rearward angle to hold products within the shelving system 10 while the product is being urged forward by the pusher paddle 14.

Figure 3:
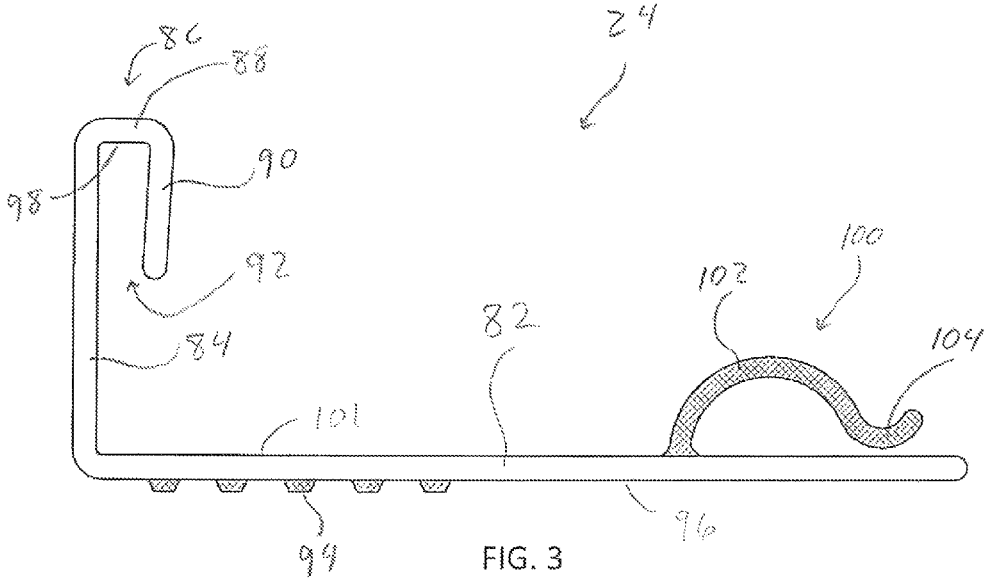
FIG. 3 is an enlarged side elevational view of the rear rail of FIG. 1.

As shown in FIG. 3, the rear rail 24 is defined by a base wall 82 and an upwardly extending generally vertically oriented wall 84 that can be located at or near the rear end of the base wall. For ease of understanding, the wall 84 will be described as the rear wall, since it is located at the rear end of the base wall 82, but other configurations are also contemplated. The rear wall 84 extends upwardly in an, orientation generally transverse to the base 82 and includes an upper edge 86. The upper edge 86 has a first leg 88 projecting generally transverse to the rear wall in a forward direction that is oriented generally perpendicular to the rear wall 84 and generally parallel to a plane of the base wall 82. A second leg 90 extends downwardly from the first leg 88 in a spaced manner from the rear wall 84. The second leg 90 can be angled towards the rear wall 84 or can be oriented generally parallel to the rear wall 84. The first leg 88 and the second leg 90 define a downwardly open channel 92. The rear wall 84, first leg 88 and second leg 90 define an elongated profile having an inner surface 98. The channel 92 is configured to receive the rectangular plate 54 of the rear end clip 52. As with the front rail 20, the rear rail 24 is cut to the length of the shelf and accommodates a plurality of elongated base members 11. The base 82 of the rear rail 24 may include a set of anti-skid ribs 94 extending along the length of a bottom face 96 of the base wall 82 proximal to the rear wall 84 for retarding movement of the rear rail 24 in relation to the shelf. Alternatively, an anti-skid layer may be used. The layer or ribs 94 can be co-extruded with or separately applied to the rear rail 24.

In one embodiment, as illustrated by FIG. 3, the rear rail 24 includes a flexible member 100 that extends upwardly from an upper face 101 of the base 82 and is configured to abut a bottom surface of the elongated base member 11. In one embodiment, the flexible member 100 comprises an arm 102 having an arcuate or curved profile in cross-section. The arm 102 can include a curved tip portion 104 that can be in the form of a reverse curvature which extends away from a distal end of the arm 102. The flexible member 100 extends collinear with the base wall 82 of the rear rail 24 but is spaced from the rear wall 84. In this embodiment, the arm 100 is curved in a first direction and the tip portion 104 is curved in a reverse or opposite direction. Of course, other designs are also possible.

In one embodiment, the flexible member 100 can be made of a suitable thermoplastic material, such as a polyvinyl chloride (PVC) material. The flexible member 100 can, however, be made of any other suitable thermoplastic material which is pliable or resilient. In one embodiment, the flexible member is coextruded with the rear rail 24, such that the rear rail is made of a relatively more rigid thermoplastic material and the flexible member is made of a relatively more flexible thermoplastic material. Thus, the rear rail is made of a relatively hard rigid plastic, whereas the flexible member 100 is made of a relatively resilient plastic. By virtue of extruding the rear rail from a plastic material, a variety of shapes are readily formed in an economical manner to provide a durable unit which is adapted for repeated use. It should be appreciated that the configuration of the rear rail 24 may change so as to accommodate a different connecting structure which engages the rear rail with a base member or cooperating member. Such cooperating member can be one or more of a divider, a track or a combination track and divider as may be desired. It can also be a side wall of a merchandising assembly supported on a shelf.

The flexible member 100 frictionally retards a lateral or sideward sliding motion of the rear end of a cooperating member which is mounted to the rear rail 24 and engages a top surface of the flexible member. Thus, a splaying or skidding of the cooperating member in relation to the rear rail 24 is retarded.

As the clip 52 is received within the open channel 92 of the rear rail 24, the bottom surface of the elongated base member 11 depresses the flexible member 100 as the elongated base member 11 is slidingly moved into position on the shelf. Once the divider wall 16 and track 12 are placed in the desired position, the flexible member 100 biases against the bottom surface 38 of the elongated base member 11 and causes the top edge 60 of the rectangular plate 54 of the rear clip 52 to frictionally abut against the inner surface 98 of the elongated profile defined by the rear wall 84, first leg 88 and second leg 90. Thus, two frictional engagements occur, one between an underside of the cooperating member and the flexible member 100, n another between the clip 52 and the elongated profile of the rear rail 24.

Regarding the embodiment of FIG. 3, in the biased position, the arcuate arm 102 bends toward the base 82 such that the tip portion 104 abuts against the bottom of the base member 11. The flexible member 100 generally flattens, relative to the unbiased arcuate profile shape, due to the pressure from the elongated base member 11 contacting it. A user can slide the elongated base member 11 laterally relative to the rear rail 24 by overcoming the friction of the flexible member against the bottom surface of the base member and the friction of the clip 52 engaging the profile (rear wall 84, first leg 88 and second leg 90). The flexible member 100 continuously asserts a bias force against the elongated base member 11 such that the top edge 60 of the clip 52 frictionally abuts against the inner surface 98 and retards lateral movement of the elongated base member 11 relative to the rear rail 24.

In operation, the shelving assembly 10 is organized on the shelf wherein the rear rail 24 and front rail 30 are placed thereon. The first end 13 of the elongated base member 11 is coupled to the front rail 20 and the opposite second end 17 of the elongated base member 11 is coupled to the rear rail 24. The flexible member abuts against the bottom face of the elongated base member 11 as the user slides the elongated base member into the desired position along the shelf. The flexible member 100 biases the elongated base member 11 and clip 52 or attachment end to abut against the elongated profile of the rear rail 24 to maintain the position of the elongated base member on the shelf relative to the rear rail 24 and retard lateral movement thereof.

Figure 4:
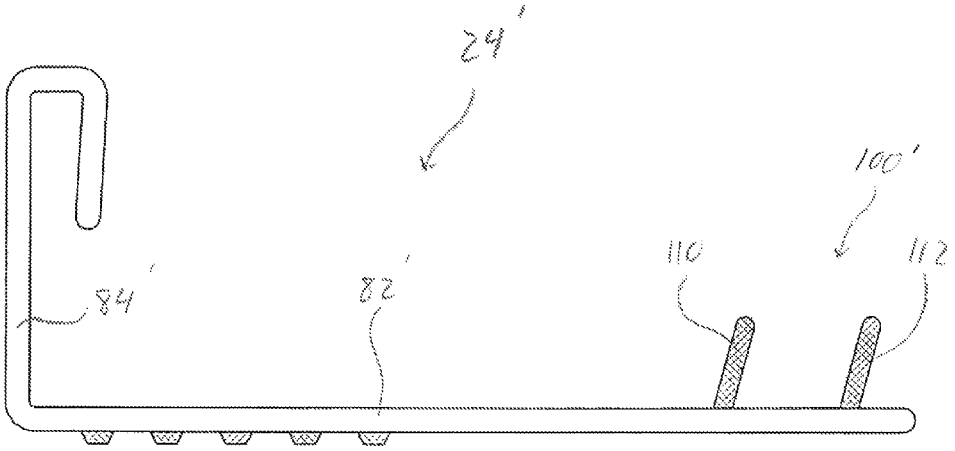
FIG. 4 is an enlarged side elevational view of another embodiment of a rear rail according to the present disclosure.

In another embodiment of the present disclosure as illustrated in FIG. 4, like features are identified by like numerals with a primed (') suffix and new features are identified by new numerals. In this embodiment, a rear rail 24' includes, a pair of spaced flexible members or fins 100'. In one configuration, a first fin or arm 110 is shown as being spaced from a second fin or arm 112. A first end of each fin 110, 112 is mounted to a top surface of a base 82' and a second end extends away from the base. The first arm 110 and second arm 112 can each include a generally linear or planar profile in cross section and the first and second arms can be collinear with a length of the base 82'. In one embodiment, the rear rail 24' extends the width of a shelf (not shown to which it is mounted.

In one embodiment the flexible members 100, 100' can be made from a flexible or resilient thermoplastic material that is generally abrasion resistant and has rapid spring back, features. For purposes of general classification, a resilient plastic has a modulus of elasticity, either in fracture or in tension, less than 700 MPA (100,000 psi) at 23° C. and 50 percent relative humidity when tested in accordance with test method D747, test method D790, test method D638M, or test method D882. The relatively resilient or flexible member 100, 100' can be a thermoplastic elastomer or a thermoplastic polyurethane. One such material can be an, ultra-high weight PVC resin having a durometer hardness measurement of about 50, however, other resilient or elastomeric materials can also be used. The anti-skid layer or ribs 94 can also be made from a similar material as the flexible members 100, 100'. The durometer of the material from which the rear rail 24, 24' itself is made is higher than is the durometer of the flexible members 100, 100'. Thus, the rear rail 24, 24' is relatively rigid in relation to the relatively flexible or resilient member 100, 100'.

While the embodiment discussed herein has focused on the rear rail 24, 24' as being the location of the one or more flexible members 100, 100', it should be appreciated that the front rail 20 could, instead, be the location of the one or more flexible members. This is particularly the case if the cooperating member is not provided with the front and rear clips 50, 52 but employs a different type of connecting arrangement for mounting the cooperating member to at least one of the front rail and the rear rail. Quite simply, the flexible member could be provided on either the front rail or the rear rail or on both, if that were considered desirable. Thus, a rail, either a front rail or a rear rail or both need merely comprise a base from which a generally vertically extending wall protrudes and at, least one relatively flexible member that is mounted to and extends away from the base, which could in one embodiment be in a spaced manner from the wall, and is configured to abut a bottom surface of the associated cooperating member to retard a lateral movement of the associated cooperating member relative to the rail.

In one embodiment, the arcuate arm 102 extends from the base 82 about 0.25 inches when in an unbiased position. In another embodiment, the linear arms or fins 110 and 112 extend from the base 82 about 0.225 inches when in the unbiased position.

As product is removed from the shelving assembly 10, the weight of product resting on the base 11 decreases. The flexible members 100, 100' can thus more strongly urge the top edge 60 of the clip 52 against the inner surface 98 of the elongated profile. This action reduces the possibility that the cooperating member will move laterally in relation to the rear rail. As product is added to the shelving assembly 10, weight is added atop the elongated base member 11. As such, the flexible members 100, 100' are depressed downwardly or flattened towards the base 82, 82', respectively, while the flexible member(s) is pressed against the elongate base member 11. Due to the additional weight on the cooperating member, lateral movement thereof in relation to the rear rail is less likely. In one embodiment, the curved tip portion 104 of the flexible member 100 can also abut against the base 82 and, at least, partially, flatten the arcuate cross-sectional shape of the flexible member 100. In both instances, the cooperating member can be slid laterally in relation to the rear rail 24, 24' when the force of friction of the flexible member 100, 100' is overcome.

The exemplary embodiments of the disclosure have been described herein. Obviously, modifications and alterations will occur to others upon reading and understanding the preceding detailed description. It is intended that the instant disclosure be construed as including all such modifications and alterations insofar as they come within the scope of the appended claims or the equivalents thereof.

The invention claimed is:

1. A shelving assembly for an associated support surface, the shelving assembly comprising:

an elongated cooperating member including a base having a first end and an opposite second end, the second end including a clip extending from the base; and a rail configured to couple to the second end of the cooperating member, the rail including a base wall and a rear wall extending from the base wall, the rear wall defining a channel configured to receive the clip, the base wall defining an uppermost surface including a first flexible member and a second flexible member, the first and second flexible members extending from the uppermost surface of the base wall and configured to urge the clip into the channel, wherein the first flexible member includes a first upper end and the second flexible member includes a second upper end, and wherein the first and second upper ends are offset from the uppermost surface of the base wall.

2. The shelving assembly according to claim 1, wherein at least one of the first and second flexible members is operable to abut the cooperating member to retard a lateral movement of the cooperating member away from a desired location along the associated support surface.

3. The shelving assembly according to claim 1, wherein at least one of the first and second flexible members is elongated and extends along the base wall of the rail.

4. The shelving assembly according to claim 1, wherein the first upper end is configured to abut the base of the cooperating member, and the second upper end is configured to abut the base of the cooperating member.

5. The shelving assembly according to claim 1, wherein the first flexible member and second flexible member each include a planar profile.

6. The shelving assembly according to claim 1, wherein the first flexible member is parallel to the second flexible member.

7. The shelving assembly according to claim 1, wherein the first flexible member extends upwardly from an upper face of the base wall at a first angle relative to the upper face, and the second flexible member extends upwardly from the upper face of the base at a second angle relative to the upper face.

8. The shelving assembly according to claim 7, wherein the first and second angles are less than ninety degrees and greater than zero degrees.

9. The shelving assembly according to claim 8, wherein the first angle is equal to the second angle.

10. The shelving assembly according to claim 1, wherein the channel opens downwardly.

11. The shelving assembly according to claim 10, wherein the clip includes a plate extending vertically upwardly from the base.

12. The shelving assembly according to claim 1, wherein the rail extends in a first direction, and wherein the channel and the first and second flexible members extend parallel to the first direction.

13. A shelving assembly for an associated support surface, the shelving assembly comprising:

an elongated rigid body including a base and a plate extending from the base; and a rail configured to couple to a distal end of the rigid body, the rail including a base wall defining an uppermost surface, a rear wall extending from the base wall, a first leg, a second leg extending between the rear wall and the first leg, and first and second flexible members extending from the uppermost surface of the base wall and configured to urge the plate into a position disposed between the rear wall and the first leg, wherein the first flexible member includes a first upper end and the second flexible member includes a second upper end, and wherein the first and second upper ends are offset from the uppermost surface of the base wall.

14. The shelving assembly according to claim 13, wherein at least one of the first and second flexible members is elongated and extends along the base wall of the rail.

15. The shelving assembly according to claim 13, wherein the first upper end is configured to abut the base of the rigid body, and the second upper end is configured to abut the base of the rigid body.

16. The shelving assembly according to claim 13, wherein the first flexible member and second flexible member each include a planar profile.

17. The shelving assembly according to claim 13, wherein the first flexible member extends upwardly from an upper face of the base wall at a first angle relative to the upper face, and the second flexible member extends upwardly from the upper face of the base wall at a second angle relative to the upper face.

18. The shelving assembly according to claim 17, wherein the first and second angles are less than ninety degrees and greater than zero degrees.

19. The shelving assembly according to claim 18, wherein the first angle is equal to the second angle.

20. The shelving assembly according to claim 13, wherein the rear wall, the first leg, and the second leg define a downwardly open channel.

21. The shelving assembly according to claim 20, wherein the plate extends vertically upwardly from the base.

22. The shelving assembly according to claim 13, wherein the rail extends in a first direction, and wherein the first and second legs and the first and second flexible members extend parallel to the first direction.

* * * * *